US005376276A

United States Patent [19]

Chung et al.

[11] Patent Number: 5,376,276

[45] Date of Patent: Dec. 27, 1994

[54] IN SITU PRIMARY FROTH QUALITY MEASUREMENTS USING MICROWAVE MONITOR

[75] Inventors: Keng H. Chung, Edmonton; Gordon R. Thompson, Edmonton; Wayne B. Jansen, Edmonton; Ethel A. Nakano, Fort McMurray; Samson Y. Ng, Sherwood Park, all of Canada

[73] Assignees: Alberta Energy Company, Ltd., Calgary; Canadian Occidental Petroleum, Ltd., Calgary; Esso Resources Canada Limited, Calgary; Gulf Canada Resources Limited, Toronto; Her Majesty the Queen in Right of the Province of Alberta as Represented by the Minister of Energy and Natural Resources, Edmonton; HBOG-Oil Sands Limited Partnership, Calgary; PanCanadian Petroleum Limited, Calgary; Petro-Canada Inc., Calgary, MOCAL Energy Limited, Calgary; Murphy Oil Company Ltd., Calgary, all of Canada, each a part interest

[21] Appl. No.: 41,385

[22] Filed: Apr. 1, 1993

Related U.S. Application Data

[63] Continuation-in-part of Ser. No. 875,767, Apr. 29, 1992, abandoned.

[51] Int. Cl.[5] ..... B01D 11/02; C10G 1/04

[52] U.S. Cl. ..... 210/634; 73/61.43; 208/390; 209/164; 210/709; 210/746; 324/637

[58] Field of Search ..... 210/634, 740, 746, 776, 210/967, 703, 709; 208/390, 391; 73/861.04, 61.44, 861.08, 61.43; 324/640, 637; 209/164

[56] References Cited

U.S. PATENT DOCUMENTS

| | | | |
|---|---|---|---|
| 3,401,110 | 9/1968 | Floyd et al. | 208/391 |
| 3,530,042 | 9/1970 | Graybill et al. | 208/391 |
| 4,545,892 | 10/1985 | Cymbalisty et al. | 208/391 |
| 4,637,417 | 1/1987 | Schramm | 208/390 |
| 4,764,718 | 8/1988 | Revus et al. | 73/61.44 |
| 4,776,949 | 10/1988 | Leung et al. | 208/391 |
| 4,852,395 | 8/1989 | Kolpak | 73/861.04 |
| 4,891,969 | 1/1990 | Waylund et al. | 37/61.44 |
| 5,009,773 | 4/1991 | Schramm et al. | 208/391 |
| 5,049,823 | 9/1991 | Castel et al. | 73/861.04 |
| 5,118,408 | 6/1992 | Jansen et al. | 208/391 |

FOREIGN PATENT DOCUMENTS

| | | | |
|---|---|---|---|
| 1059052 | 7/1979 | Canada | 208/425 |
| 1139702 | 1/1983 | Canada | 208/391 |

*Primary Examiner*—Joseph W. Drodge
*Attorney, Agent, or Firm*—Millen, White, Zelano & Branigan

[57] ABSTRACT

Aerated bitumen froth containing bitumen, water, air and solids is the product of the hot water extraction process for recovering bitumen from oil sand. Measurements related to the water content of the froth can be obtained by measuring its resonant frequency in a calibrated output, open-ended microwave cavity. By also measuring the bulk density of the froth and assuming a constant relationship for the solids content, one can compute from the assembled data the output quality of the froth. The measurements can be taken repetitively at the vessel as the froth is produced and used to almost instantly provide froth quality information.

7 Claims, 11 Drawing Sheets

Volume Fraction of Oil, Water, Solids and Air as a Function of Bulk Density for Aerated Primary Froths.

Predicted and Measured Primary Froth Composition. EEC900516 Run (9003 B Tar Sands)

PSV Froth Water Content Estimated by Froth Quality Sensors vs. Assays

Time Trend Plot of PSV Froth Quality Estimated by Sensors vs. Assays

IN SITU PRIMARY FROTH QUALITY MEASUREMENTS USING MICROWAVE MONITOR

This application is a continuation-in-part of our application for U.S. Letters Patent Ser. No. 07/875,767 filed Apr. 29, 1992, now abandoned.

FIELD OF THE INVENTION

This invention relates to a method for continuously establishing values for the volume or weight fractions of bitumen and water in aerated bitumen froth produced by a separation vessel in a hot water extraction process circuit. The method comprises measuring froth water content with microwave means, measuring froth bulk density, assuming a froth solids content and calculating froth bitumen content using the foregoing information.

BACKGROUND OF THE INVENTION

The hot water extraction process for recovering bitumen from oil sand has been extensively described in the prior art. In general this process, as embodied in applicant's plant, involves:

Mixing the oil sand with hot water and a small amount of caustic in a rotating horizontal drum (called the "tumbler"). The tumbler has a slight downward tilt so that the mixture moves longitudinally therethrough over a retention period of about 3 minutes. Rotation of the tumbler causes cascading of the mixture, with the result that air bubbles are entrained in the slurry. In the course of this mixing step, bitumen is heated, separated from the sand grains and dispersed into the water phase in the form of small flecks. Some of these flecks become aerated by contacting and coating air bubbles;

The slurry exiting the tumbler is diluted with additional hot water;

The diluted slurry is temporarily retained in a vessel referred to as a primary separation vessel ("PSV"). This vessel is open-topped and has a cylindrical upper end and a conical lower end. The slurry is retained in the vessel for about 45 minutes under generally quiescent conditions. In the course of this step, some of the bitumen that has been sufficiently aerated rises and forms froth which overflows the lip of the vessel and is collected in a launder and is recovered. This aerated froth is referred to as "primary froth". Sand in the slurry settles and is removed through a bottom outlet of the PSV as a tailings stream. A watery "middlings" stream containing some fine solids and bitumen is removed from the PSV mid-section;

The middlings and tailings are combined and subjected to aeration and flotation in a tailings oil recovery vessel ("TORV") in accordance with U.S. Pat. No. 4,545,892. The TORV recovers additional bitumen or oil in the form of what is referred to as post-primary froth; and Middlings from the TORV may be subjected to intensive aeration, impeller mixing and flotation in a series of flotation cells to recover residual bitumen in the form of a "secondary" post-primary froth.

The primary, TORV and secondary post-primary froth streams each contain bitumen (or oil), water, solids and air. The contamination with water and solids increases through the sequence of primary, TORV and secondary froths.

To closely control and fine tune the extraction process, it is highly desirable to be able to determine the relative amounts of oil, water and solids in the streams of aerated froth, on a virtually instantaneous basis which lends itself to automatic on-stream implementation.

In the past, the system used has involved taking froth grab samples and analyzing them by soxhlet extraction for oil, water and solids contents. The problem with this system is that the results of the analysis are not obtained until many hours after taking the sample. Since the nature of the oil sand feed and the composition of the produced froth streams vary constantly, the analyzed composition data are little help in controlling the variables involved with the process (such as caustic additions), to fine tune it to the current throughput. As a result, variable control has been an art that greatly depended on the skill and experience of the operators, who primarily have depended on visual assessment of the process.

There has therefore long existed a need for a method for quickly and continuously establishing the composition or quality of the aerated bitumen froth. It is the object of this invention to provide such a method.

SUMMARY OF THE INVENTION

The present invention is based on two discoveries. The first is that the volumetric content of solids in the froth remains essentially constant, even though the composition otherwise of the froth is varying constantly. The second discovery is that a properly constructed and arranged microwave cell instrument can be calibrated to yield useful measurements, when applied to aerated bitumen froth, which are indicative of the water content of the froth. In a preferred embodiment, applicants utilize a microwave cell that forms an open-ended or tubular resonant cavity or bore in which are provided a pair of spaced apart probes for emitting and receiving microwave energy. Electronics, coupled with the cell, form an instrument adapted to determine the resonant frequency within the cell which is associated with the dielectric constant of the froth in the cell and the unchanging architecture of the cell. We have found that the dielectric constant of froth predominantly indicates the water content. When the cell is submerged in the froth layer of a PSV so that the froth flows through the bore, the instrument output is closely indicative of the water content of the froth.

Having ascertained the foregoing, applicants have gone on to measure the bulk density of the froth. Having assembled measured data and having made simplifying assumptions for certain variables, applicants developed and used a relationship to determine the fraction of the water content in the froth. The relationship comprises: the variables of froth dielectric constant and froth bulk density; and modifying constants arising from the mathematical formulation of the final form of the relationship and those resulting from a calibration procedure. For maximum accuracy, the instrument output is preferably calibrated by repetitively and simultaneously monitoring each of the froth bulk density, the instrument output, and representative laboratory assay analyses. The resulting relationship is utilized to compute the volume or weight fraction of water in the froth. Tests have shown that the measurement and computation results provide an indication or water content that is reasonably close to laboratory assay analysis results. Having the water and solids contents, one can then calculate the weight fraction of the oil in the froth and thereby obtain a useful on-line, continuous analysis technique defining froth quality.

In subsequent testing in a commercial application, it was determined that the solids content could be defined using several different assumptions or models, including the original constant volume discovery. Alternatively, it was further determined that a multiple regression analysis of the test data could result in a relationship that was simply a function of microwave instrument output and bulk density.

Broadly stated then, applicants have devised a process that comprises:

repetitively establishing on-line measurements indicative of the mixture dielectric of the aerated bitumen froth layer in a vessel using a microwave cell submerged in the froth and having a resonant cavity through which the froth flows;

repetitively measuring on-line the bulk density of the froth layer; and using the two sets of measured values and the essentially constant value for solids content and continuously computing values indicative of the water content and oil content.

DESCRIPTION OF THE PREFERRED EMBODIMENT

Figure 1:
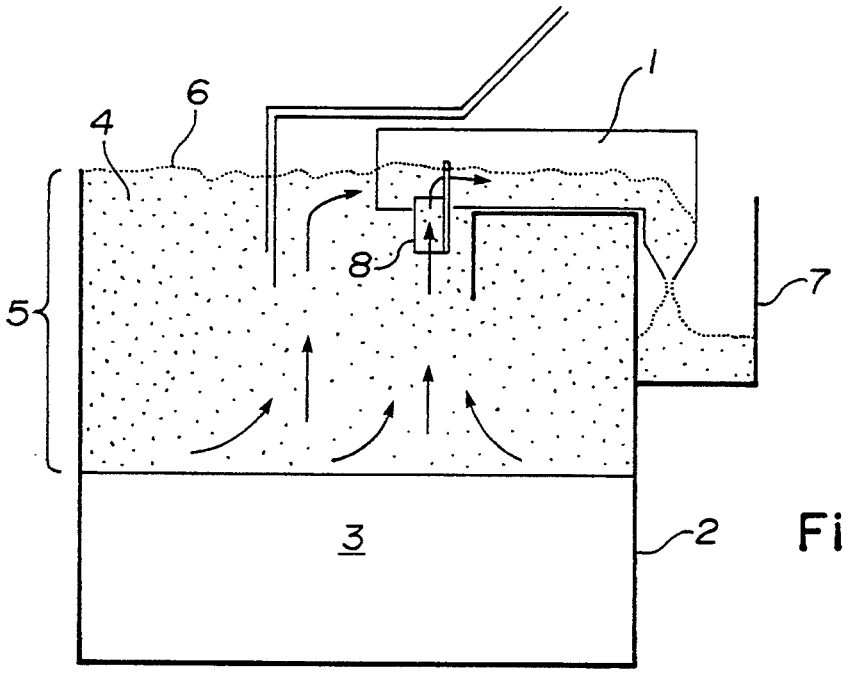
FIG. 1 is a cross section of a pilot test installation on a PSV, illustrating the froth sampling trough and the installation of the microwave froth quality monitor and bulk density sensing lines.

Referring now to the Figures, FIG. 1 illustrates a froth sampling trough 1 used in a pilot test on a commercial-scale primary separation vessel (PSV) 2. Although the pilot test was performed on the PSV 2, the method of the present invention may be practiced on aerated bitumen froth from other like streams and vessels such as the tailings oil recovery vessel (TORV). In the PSV, aerated bitumen 3 rises and forms a froth 4 which resides in a froth layer 5. The froth 4 establishes a froth level 6 which overflows the lip of the PSV 2, traverses the sampling trough 1 and collects in a launder 7 for removal. As the froth 4 rises and flows into the trough 1, it passes through a microwave cell 8.

Figure 2:
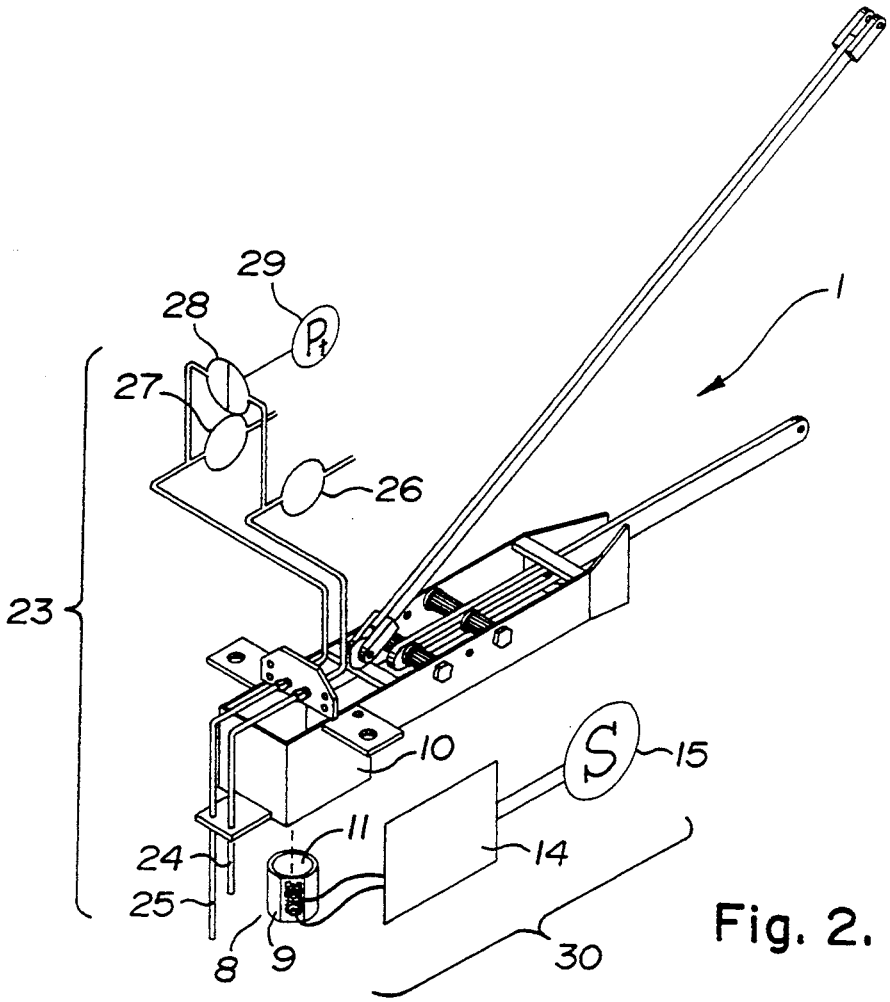
FIG. 2 is an isometric view of the froth sampling trough, density sensing lines and microwave sensing cell.
Figure 3:
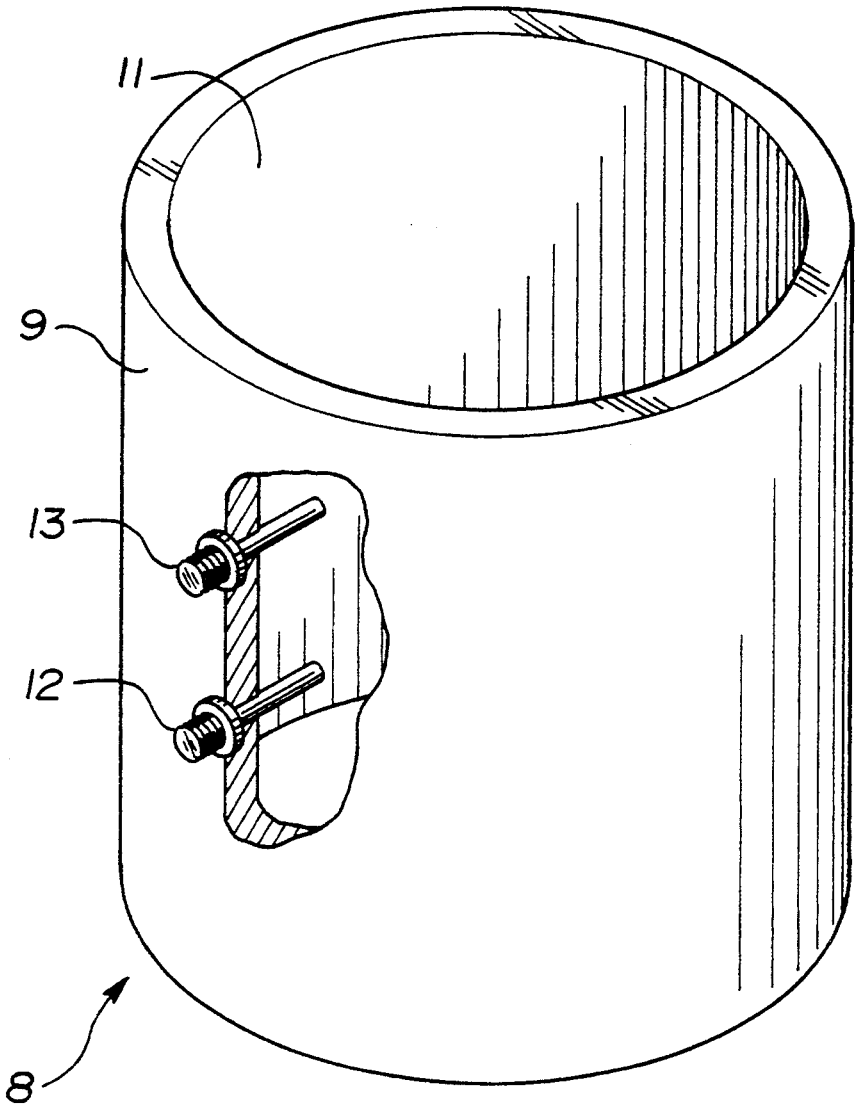
FIG. 3 is a cut-away view of the microwave resonance cavity.

FIG. 2 more clearly illustrates the sampling trough 1 used in the pilot test. FIG. 3 shows the microwave cell 8 in more detail.

The microwave cell 8 comprises a 2.5 inch internal diameter, open-ended cylindrical aluminum tube 9, 3.25 inches in height, that is mounted in the entrance 10 of the sampling trough 1. The axis of the tube 9 is oriented vertically with the upper end about 3 inches below the froth level 6, thus being completely immersed in the froth 4. The tube 9 forms an open-ended resonant cavity or bore 11. A pair of vertically spaced antennae 12,13 are mounted into the tube 9 and extend radially into the bore 11. The first antenna 12 is adapted to introduce microwave energy while the second antenna 13 is used as the receiver. The first antenna 12 is adapted to transmit microwave frequencies in the range 500 to 1500 Mhz at a power level of about 10 mW. The required range of microwave frequencies used is a function of the particular nature of the dielectric constant of the froth 4 and the length of the tube 9. The center to center spacing of the antennae 12,13 is 1.25 inches. Electronics 14 provided in combination with the microwave cell 8 provide a means whereby a resonant frequency (f) of microwave energy in the froth 4 may be determined to generate an output signal 15 which provides a measure of the water content of the froth. The output signal 15 is symbolically depicted as S.

Figure 4:
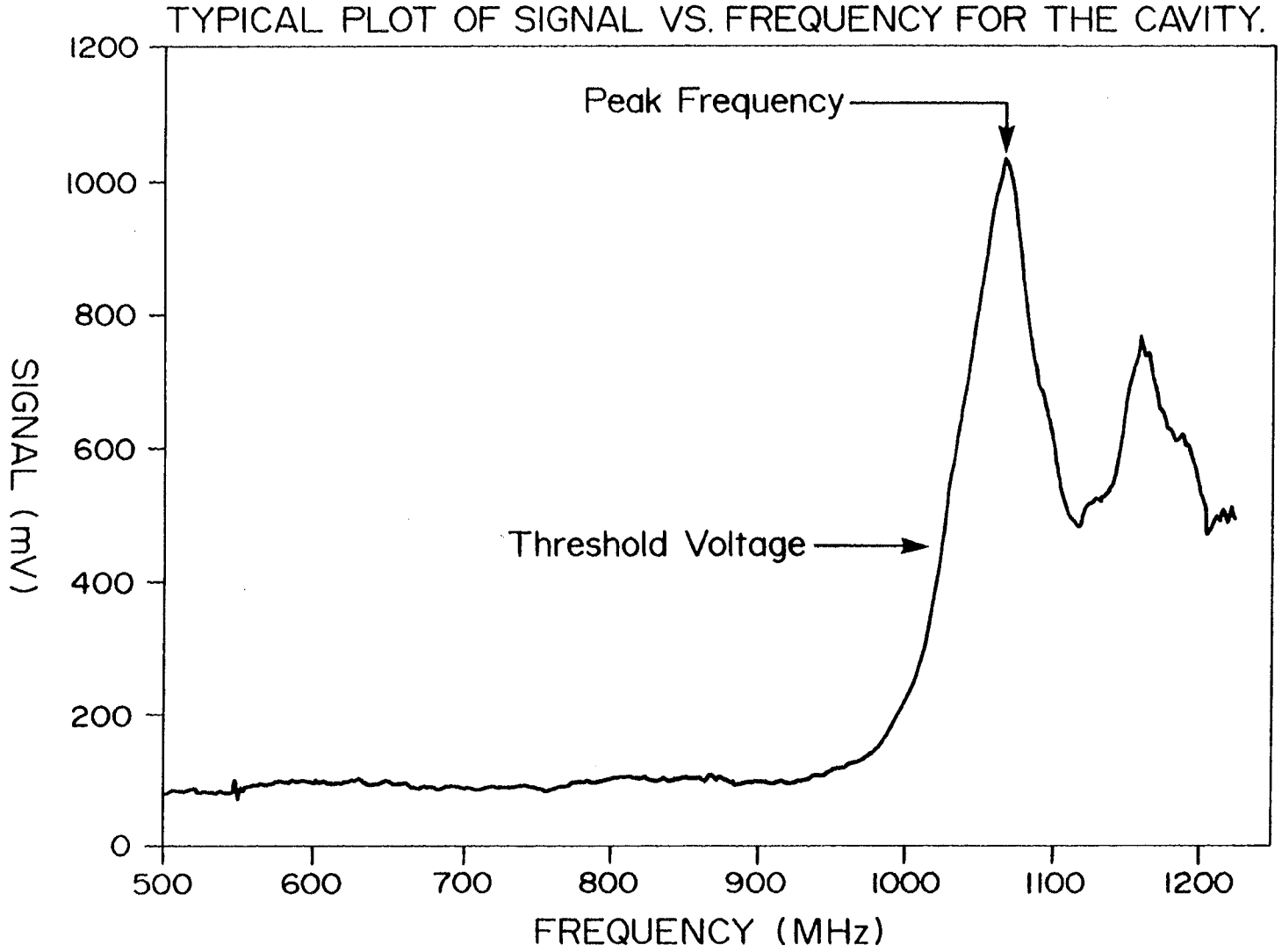
FIG. 4 is a plot of the typical millivolt output signal response of a microwave intensity detector which is adapted to monitor the intensity of microwave energy with a resonant cavity.

The electronics 14 operate on a basic principle that the lowest resonant frequency of microwaves in the cavity 11 is inversely proportional to both the axial length of the cavity, and the square root of the dielectric constant of the sample contained within the cavity. Thus, for a cavity of constant length, as provided by the tube 9, an increase in the dielectric constant of the froth 4, contained within the cavity 11, will manifest as a lower resonant frequency f. When the receiving antenna 13 picks up microwave signals, a voltage signal is produced. When the resonant frequency f is detected, the voltage signal increases significantly. FIG. 4 presents a typical trace of the antenna 13 output signal as the frequency varies and reaches a resonance frequency peak, as indicated by a dramatic increase in signal strength, surpassing a level referred to as a threshold voltage. The objective of the electronics 14 is to locate and track the frequency at which this threshold voltage occurs and monitor any changes; changes indicate that the froth dielectric constant is also changing.

Figure 5:
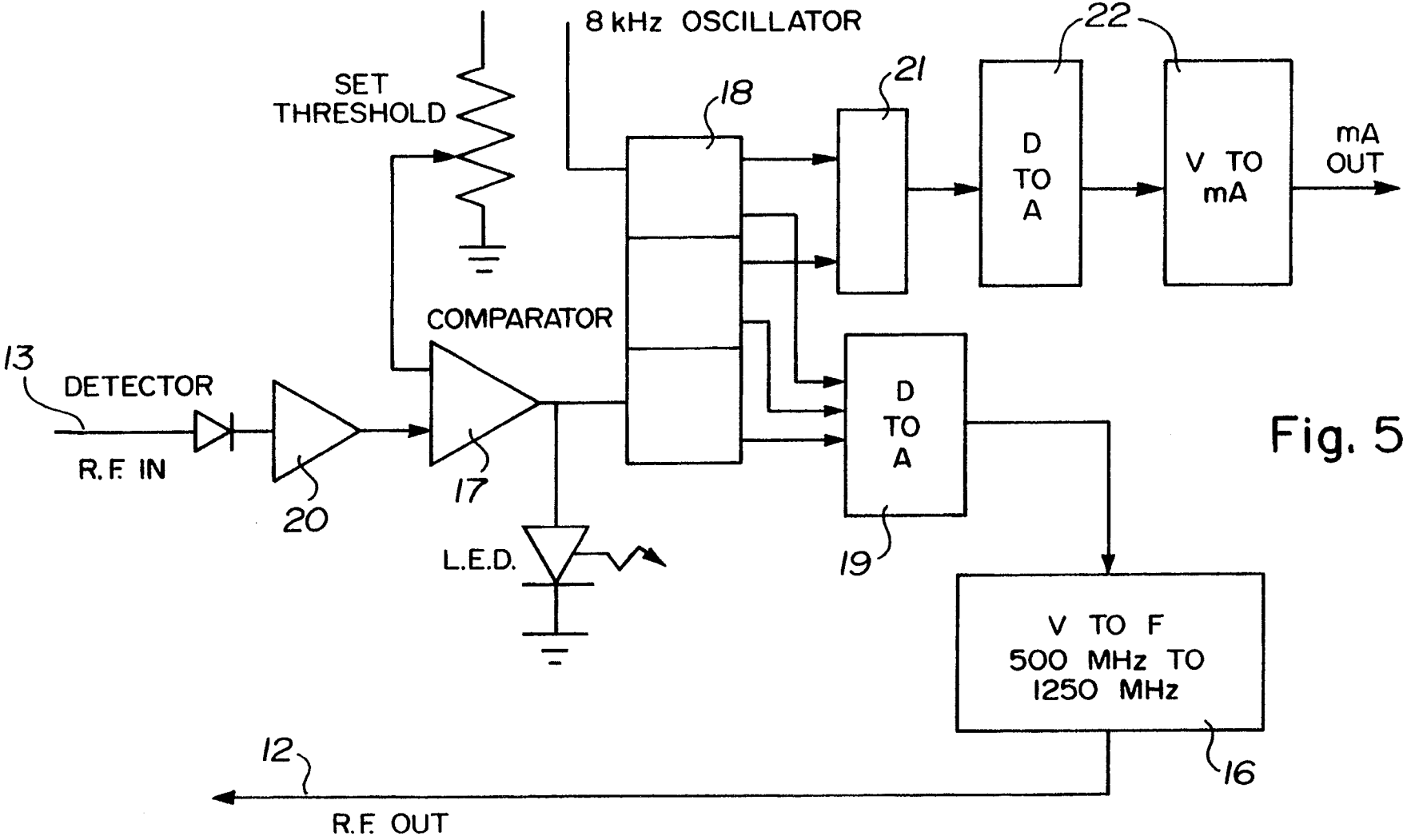
FIG. 5 is a block diagram of a digital system adapted to monitor and measure the resonant frequency of microwaves in a suitably configured resonant cavity, and to convert the measured frequency to a measure indicative of the dielectric constant of the microwave cell contents.

Referring to FIG. 5, a digital system of conventional electronic componentry is presented, for enabling the tracking of the resonant frequency. The structure of the electronics is now described by their function only, as detailed design of such digital systems is well known to those skilled in the art.

An oscillator 16 generates microwave frequencies and transmits them from antenna 12. The oscillator is initially set to generate frequencies at a minimum frequency below those that would produce threshold voltages. A comparator 17 then signals a counter 18 to begin counting upwards, sending the increased count through a digital-to-analog converter 19, raising the tuning voltage to the oscillator 16, thus raising the frequency being transmitted to the cavity 11. The discontinuity of the open-end of the cavity creates a sharp impedance change, reflecting back a portion of the microwaves. A detector 20 measures the intensity of the microwaves received at the antenna 13, which then outputs a signal to the comparator. At the resonance frequency, a part of the microwave is reflected back, reinforced by the microwave being introduced, and reflected back from the other end of the cavity, ultimately building to a high intensity. When the signal from the detector 20 rises above the threshold voltage, the resonance peak frequency is considered to have been located. The comparator 17 then signals the counter to begin lowering the count, thus lowering the tuning voltage to the oscillator, resulting in lower frequencies being transmitted to the cavity 11.

The comparator 17 detects the point at which the detector signal again drops below the threshold voltage and again reverses the counter 18, to begin counting upwards. The comparator 17 and counter 18 cooperate to cycle the counter about the threshold voltage, thus maintaining the counter output at a level representative of the resonant frequency. If the dielectric constant of the froth 4 changes upwards or downwards, the counter will track the changes accordingly.

The counter 18 is monitored by an EPROM 21 which is pre-programmed to contain a look-up table of values relating the counter output to dielectric constant of oil and water mixtures. The look-up table handles the conversion of the number of counts to the tuning voltage signal to the oscillator 16. The tuning voltage then is related to the actual frequency output of the oscillator which can be a non-linear and non-regular relationship. The frequency is then converted to a value indicative of the dielectric constant of the froth, which is a squared relationship. The digital output of the EPROM is preferably output to means 22 for digital-to-analog conversion which provides a milli-amp signal 15 and S suitable for process control purposes.

Figure 6:
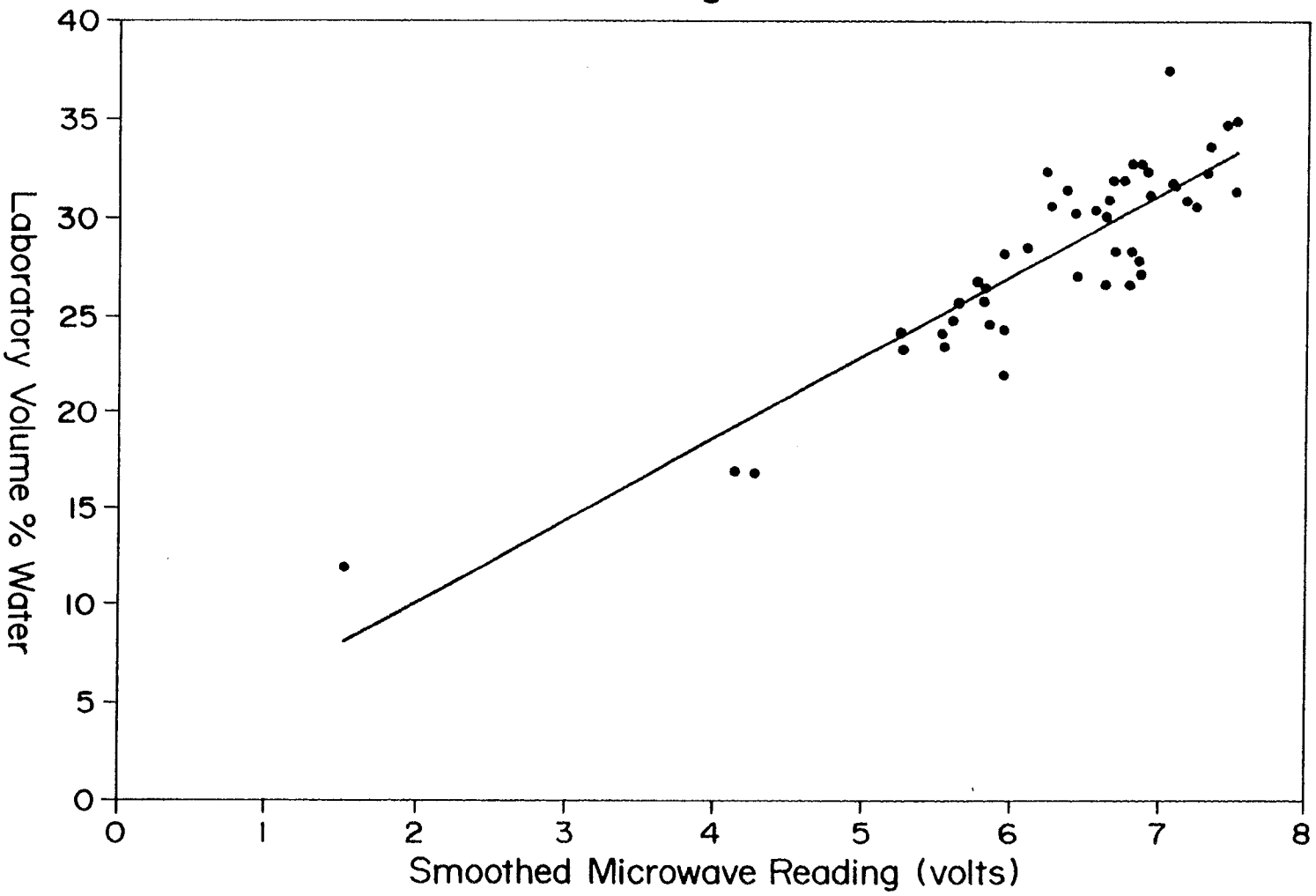
FIG. 6 is a plot of the microwave instrument output signal against laboratory assay of water fraction in froth, values adjusted for density.

It may be noted that the relative dielectric constants of oil, solids, and air are 30 to 60 times less than that for water and thus changes in froth dielectric constant are attributed to changes in water content. FIG. 6 shows the output signal 15, corrected for the density of the froth, plotted against laboratory assay, demonstrating the good correlation of the microwave instrument output and water content in froth 4 on a volume basis.

The microwave cell 8, and the electronics 14 together form a froth quality monitor 30 which has as its output the signal S.

The froth quality monitor 30, having been pre-calibrated on air-free oil and water mixtures, is unable to directly output the fraction of water in the froth 4 without being corrected for the reduced density of the froth due its aerated nature. To compensate for the air content of the froth 4, bulk density must be determined.

The bulk density of the froth 4 is continuously measured using a froth bulk density sensing means 23 comprising conventional air bubbler device components. Two sense lines 24,25 project into the froth layer 5, terminating at two distinct depths, vertically offset by a distance of 2 to 5 inches. Two flow rotameters 26,27 are connected to purge the sense lines 24,25, each providing 20 to 60 $cm^3$/min of air, developing back-pressure proportional to the fluid pressure displaced from the ends of the sense lines 24,25, projecting into the froth 4. A differential pressure transmitter 28 is adapted to the sense lines 24,25 to establish the difference in back-pressure between the disparate sense lines 24,25. A suitable output means 29 is adapted to the transmitter 28 to provide a measure indicative of the bulk density of the froth, suitable for use with some form of process control. The output 29 is symbolically depicted as $\rho_t$. The bulk density sensor 23 is calibrated so that a reading of zero percent of scale is obtained with the density sense lines 24,25 in air and a reading of 100 percent of scale is obtained with the density sense lines 24,25 in water.

Four examples are provided to illustrate the background of the discovery and the practice of the invention.

In Example I, data to support the original discovery that the volume fraction of solids in aerated bitumen froth remains a constant, is presented.

In Example II, the second discovery that microwave instrument output is proportional to water content in froth is used in combination with the assumption that the volume fraction of solids remains constant to derive equations which express the froth quality in terms of microwave output and froth bulk density. Data is presented to demonstrate the accuracy of the prediction of these equations against actual laboratory assay of aerated bitumen froth.

In Example III, froth quality prediction equations are derived when solids content on a mass basis is assumed to remain constant. Data is presented to demonstrate the accuracy of the prediction of these equations against actual laboratory assay of aerated bitumen froth.

Example IV illustrates a later discovery that good predictions of froth quality can be made using a number of different assumptions with respect to the phenomenon of constant solids content in the froth.

EXAMPLE I

This example supports the original discovery and assertion that the volume fraction of solids in aerated primary froth from a hot water extraction process can be assumed to be substantially constant at about 2 vol. % for different grades of oil sand and varying operating conditions.

Applicant analyzed data derived from processing various grades of oil sand in an Experimental Extraction Circuit (EEC) using the hot water extraction process. Extraction runs were conducted at 48°–53° C. and 72°–84° C. ("50° C.", and "80° C." extraction conditions). Since neither the hot water process itself nor the EEC are part of the present invention, they will not be described.

The EEC produced aerated primary froths. Samples of each froth were subjected to bulk density measurement and to composition analysis by laboratory assay.

Bulk density ($\rho_t$) was determined by weighing a known volume of froth.

Alternatively the bulk density was continuously monitored by using a differential pressure transmitter (DP cell), such as the Barton instruments Model 6001. To do that, a pressure pipe was connected on one end to the high pressure input to the DP cell and was installed 7.5 cm into the froth layer in the PSV. A reference leg was connected to the low side of the DP cell and was installed 2.5 cm into the PSV. The pressure pipes were purged with air at a rate of 20 $cm^3$/min. The resulting differential pressure between these two points was measured by the DP cell, and used to compute the bulk density ($\rho_t$).

An oil/water/solids analysis was performed on each froth using the soxhlet extraction technique described in the Syncrude Analytical Methods for Oil Sand and Bitumen processing, Bulmer, J. T. and Starr, J., published by the Alberta Oil Sands Technology and Research Authority in 1979.

Figure 8:
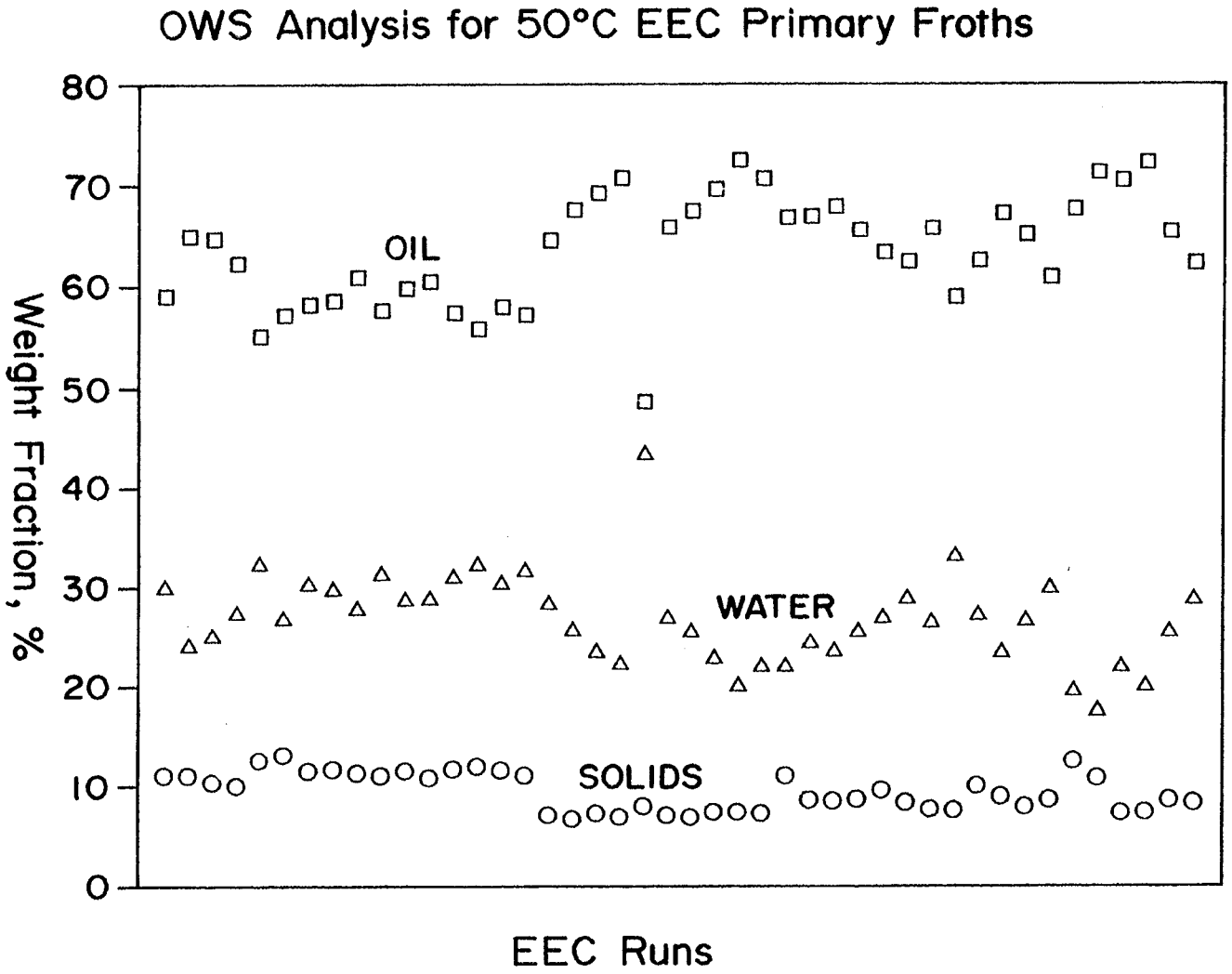
FIG. 8 is a plot showing experimental analysis assay results, reported in weight fractions for oil, water and solids in 50° C. froth samples produced by numerous runs in a hot water process extraction unit ("EEC")
Figure 9:
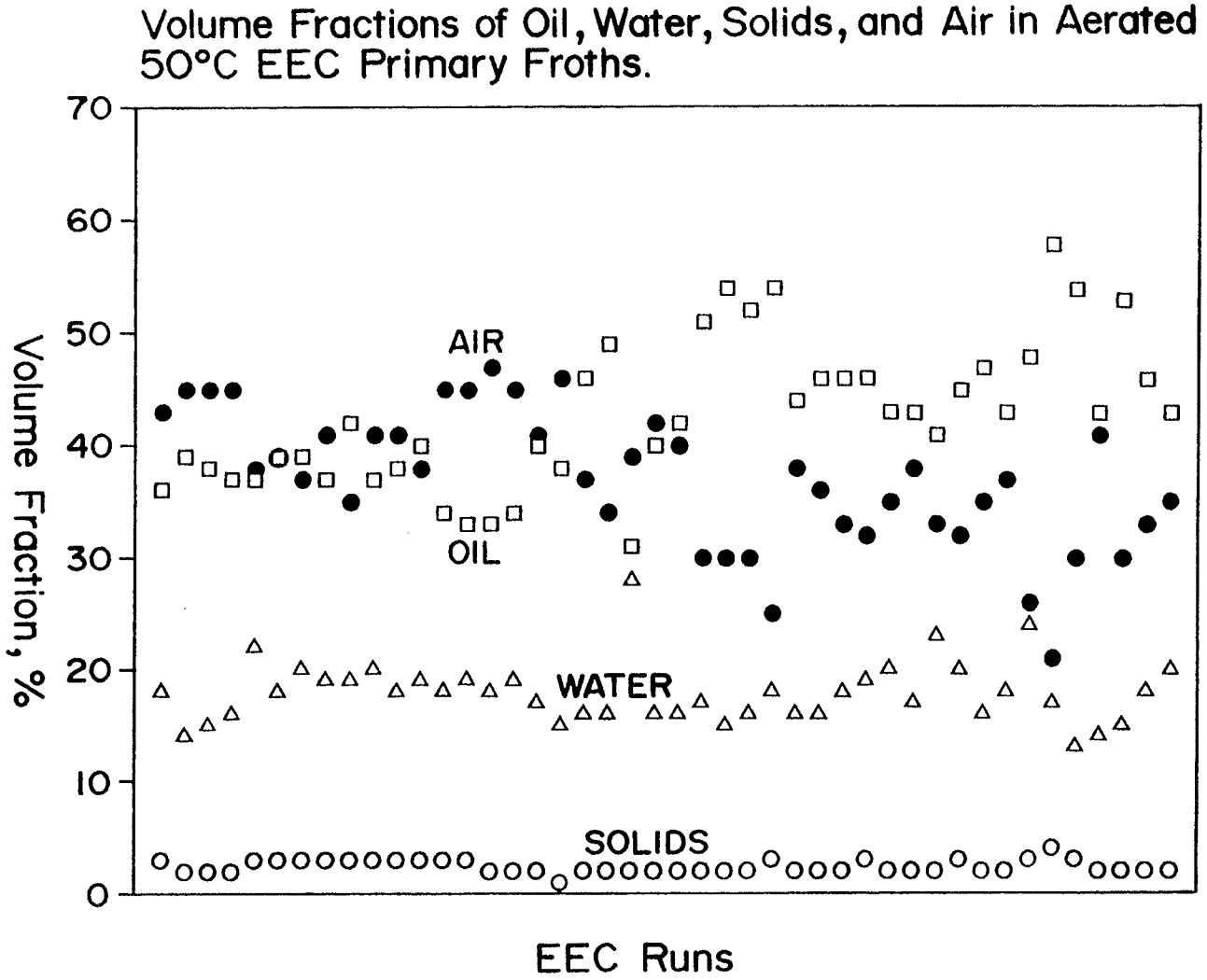
FIG. 9 is a plot showing weight fractions converted to volume fractions of oil, water, solids and air in the froth samples of FIG. 8, derived by calculation from the assays of FIG. 8 and measured bulk densities.

FIG. 8 shows the froth assays on a weight basis for 50° C. EEC primary froths. FIG. 9 shows the same froth assays converted to a volumetric basis using the following equations:

$$v_o = \frac{m_o}{\rho_o}\rho_t \quad (1)$$

$$v_w = \frac{m_w}{\rho_w}\rho_t \quad (2)$$

$$v_s = \frac{m_s}{\rho_s}\rho_t \quad (3)$$

$$v_a = 1 - v_o - v_w - v_s \quad (4)$$

where $m_i$ denotes the weight or mass fraction, and $v_i$ the volume fraction of an aerated froth component, oil, water or solids (o,w,s).

The densities used for bitumen and water ($\rho_o$, $\rho_w$) were both 1.00 g/ml.

The density used for solids ($\rho_s$) was 2.65 g/ml.

The results in FIG. 8 showed that the solids content volume fraction was essentially constant at about 2 vol. %. The water volume fractions varied with an average value of about 18%.

Figure 10:
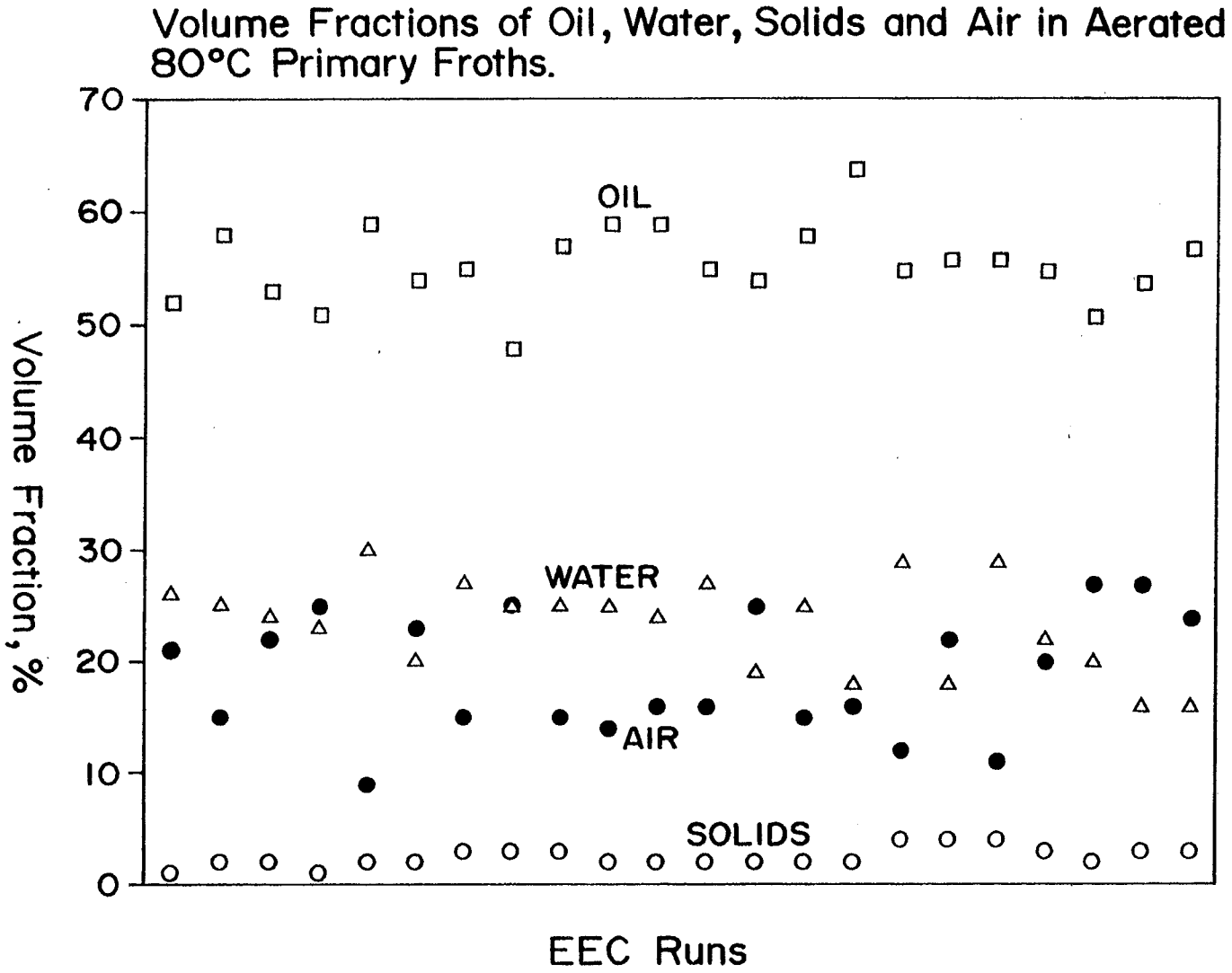
FIG. 10 is a plot showing volume fractions of oil, water, solids and air in 80° C. froth samples produced by numerous runs in the hot water process extraction unit.

FIG. 10 shows the froth assay data converted to volume fraction, for froths produced during runs operated at 80° C. Again, the solids volume fractions remained essentially constant at about 2 vol. %. However, at the higher operating temperature, the water volume fractions varied significantly about an average value of about 24%.

In summary then, the volume fraction of solids in the froths produced at 50° C. and 80° C. was the only measure to remain essentially constant throughout. Its value was about 2 vol. %. This discovery reduced, by one, the number of variables which needed to be determined to establish a predictive equation for the determination of the quality of the aerated froth.

EXAMPLE II

To determine the quality of the aerated froth, one needs to assemble all of the known data and solve for the unknown variables, two unknowns being the composition of the aerated froth with respect to oil and water content. Having ascertained that the volume fraction of solids in aerated froth remains constant, the solution is now determinate. A derivation of a froth quality equation is presented, with simplifying assumptions and relationships being presented as required.

Since the densities of bitumen (oil, $\rho_o$) and water ($\rho_w$) are virtually the same, $\rho_o$ and $92_w$ can each be assumed to be 1.0 g/ml. The density of the solids ($\rho_s$) is about 2.65 g/ml and the density of air ($\rho_a$) is about 1000 times smaller at approximately 0.001 g/ml. Since the density of air is negligible in comparison to the densities of oil, water and solids, $\rho_a$ can be assumed to be zero.

If v represents volume fraction of an aerated froth component, the following equations apply:

$$v_o+v_w+v_a+v_s=1.0 \quad (5)$$

$$v_s=0.02 \quad (6)$$

$$v_o+v_w=0.98-v_a \quad (7)$$

Figure 7:
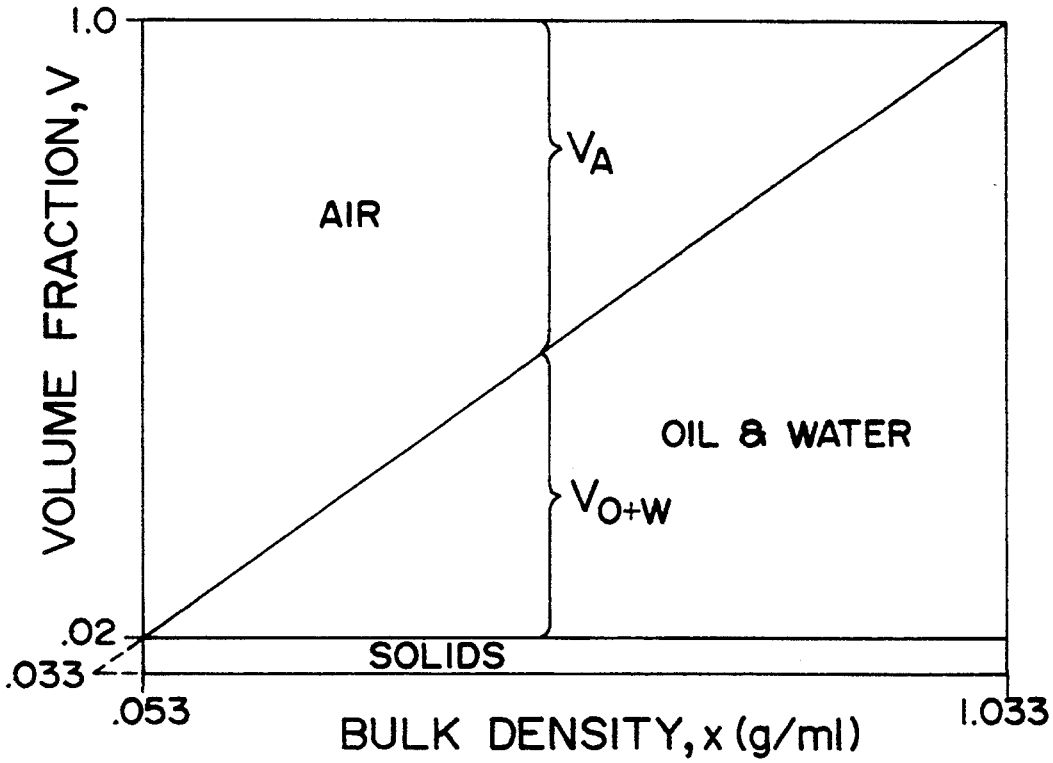
FIG. 7 is a plot of the volume fractions of oil plus water, solids and air as a function of bulk density for aerated primary froth.

Due to the similar densities of water and oil (as bitumen), a linear relationship of oil and water volume fractions as a function of bulk density ($\rho_t$) can be expressed graphically in the form shown in FIG. 7.

The two end points that define the linear relationship are computed as follows:

TABLE I

| | | Volume Fraction | | | |
|---|---|---|---|---|---|
| | | First end point | | Second End Point | |
| Component | Density g/$cm^3$ | % | Mass g | % | Mass g |
| solids | 2.65 | 2 | 0.053 | 2 | 0.053 |
| Water+oil | 1 | 0 | 0 | 98 | 0.98 |
| air | 0 | 98 | 0 | 0 | 0 |
| bulk density | | | 0.053 | | 1.033 |

Using FIG. 7, the expression of volume fractions of oil and water can be written as follows:

$$v_{(o+w)}=\rho_t-0.053 \quad (8)$$

$$v_o=\rho_t-0.053-v_w \quad (9)$$

The air volume fraction ($v_a$) can be obtained by substituting Equations (6) and (8) into Equation (5) giving:

$$v_a=1.033-\rho_t \quad (10)$$

In order to calculate $v_o$ or $v_w$ from equation (9) it is necessary to determine one of them in another manner.

The froth dielectric constant (S) of the aerated froth has been found useful in providing another equation which involves $v_o$ and $v_w$. The dielectric constant of a mixture is assumed to be the sum of its individual component dielectric constants on a volume basis. More particularly:

$$S=S_o+S_w+S_s+S_a \quad (11)$$

$$S=(\epsilon v)_o+(\epsilon v)_w+(\epsilon v)_s+(\epsilon v)_a \quad (12)$$

where $\epsilon$ is the dielectric constant of microwave for the component involved. The dielectric constant $\epsilon$ for oil, solids and air is relatively constant, and $\epsilon$ for water varies with temperature. These values are disclosed in Von Hippel, A., *Dielectric Material and Applications,* The Technology Press of M.I.T., John Wiley (1954) and Nyfors, E. and Vainikainen, P., *Industrial Microwave Sensors,* Artech House, Inc., Morwood, Mass. (1989).

Therefore, by way of example, substituting textbook values for $\epsilon$ at 75° C.:

$$S=2.6v_o+60.5v_w+2.5v_s+1.0v_a \quad (13)$$

Substituting equations (6), (9) and (10) in equation (13) one derives:

$$S=2.6(\rho_t-0.053-v_w)+60.5v_w+2.5(0.02)+1(1.033-\rho_t) \quad (14)$$

which simplifies to:

$$S=1.6\rho_t+57.9v_w+0.9452 \quad (15)$$

which can be rearranged to:

$$v_w=\frac{(S-1.6\rho_t-0.9452)}{57.9} \quad (16)$$

From equation (16), $v_w$ can be determined from the measured output (S) of the microwave froth quality monitor and bulk density ($\rho_t$). This value can be used to determine $v_o$ using equation (9).

The final step in determining the quality of the aerated bitumen froth was to obtain values for the froth quality monitor output and the froth bulk density for insertion into equation (16) and confirm them against actual test results. A froth quality monitor, of the foregoing description and construction, was installed into the flowing froth of the EEC, produced at a temperature of 75° C. As the froth was being continuously produced, measurements of its bulk density, measured using a DP cell, and output from the froth quality monitor were continuously obtained.

The oil, water and solids contents of grab froth samples were determined using soxhlet extraction and converted into volume fractions.

To better relate the theoretical derivation of equation (16), derived using a relationship for component dielectric constants, to actual experimental operation results, a calibration of equation (16) needed to be performed.

A calibration constant (k) was determined for the cell, modifying the calculated output value, based on the results of the experimental run on froth, in which the volume fractions of froth components were determined for a set of grab samples and compared against the simultaneously measured and subsequently computed values from equation (16). The calibration constant modifies equation 16 giving:

$$v_w=\frac{(kS-1.6\rho_t-0.9452)}{57.9} \quad (17)$$

The volume fractions of water and oil were calculated or predicted using equations (17) and (9).

Figure 11:
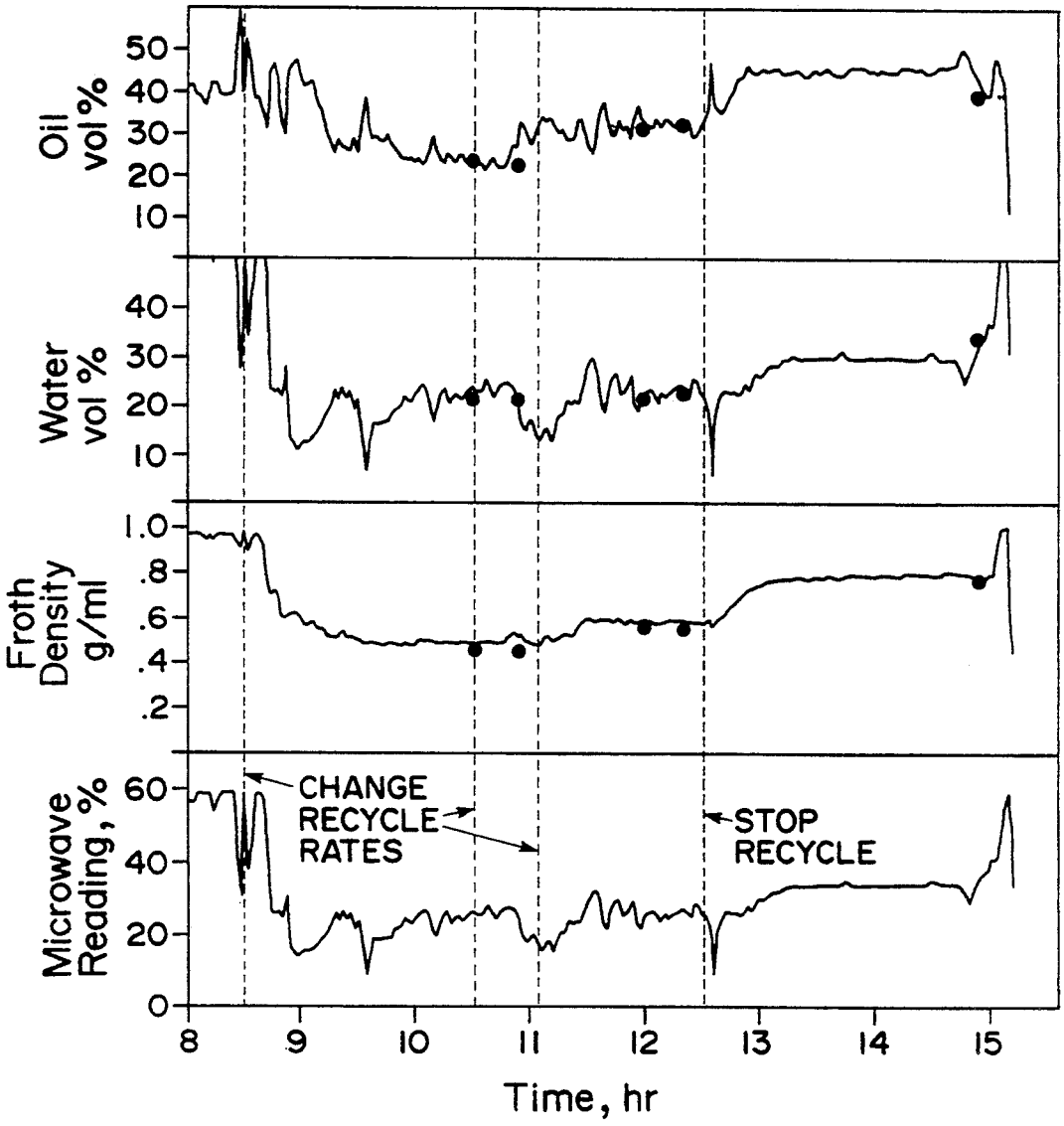
FIG. 11 is a plot showing predicted values obtained for oil and water volume fractions using in-situ froth quality measurements made in accordance with the invention for the EEC pilot plant, and compares the values obtained with those determined from grab samples (individual data points) indicated by dots.

A comparison of the measured and calculated volume fractions is shown in the following Table II and in FIG. 11. The solid lines in FIG. 11 represent the in-situ froth quality measurements. The froth quality monitor readings and froth bulk densities were logged continuously and were used to compute the corresponding water and oil volume fractions. The data points were determined by grab samples. Table II shows the good correspondence between the measured versus predicted values.

TABLE II

| Time hr. | Froth Density g/ml | Microwave Reading* % | Oil Predicted vol. % | Oil Measured vol. % | Water Predicted vol. % | Water Measured vol. % | Solids Assumed vol. % | Solids Measured vol. % |
|---|---|---|---|---|---|---|---|---|
| 10:30 | 0.4854 | 27.125 | 19.32 | 23.36 | 23.92 | 20.41 | 2.00 | 1.56 |
| 10:54 | 0.5137 | 24.938 | 24.40 | 22.00 | 21.67 | 20.41 | 2.00 | 1.53 |
| 12:00 | 0.5879 | 25.813 | 31.16 | 30.81 | 22.33 | 21.07 | 2.00 | 1.65 |
| 12:20 | 0.5782 | 27.688 | 28.30 | 30.90 | 24.22 | 21.73 | 2.00 | 1.64 |
| 14:50 | 0.7793 | 37.875 | 38.87 | 39.18 | 33.76 | 33.05 | 2.00 | 1.94 |

*The calibration constant k used in the calculations was 0.574.

In summary then, having made an assumption for the solids content, and by measuring the output (S) from the froth quality monitor for aerated froth and bulk density ($\rho_t$), one can establish useful measures of the volume fractions of water and oil in the aerated froth. With this information one can calculate useful measures of the weight fractions of oil, water and solids in the froth.

EXAMPLE III

This example demonstrates that equations, developed to determine the quality of aerated froth, may alternately be derived by assuming that the solids content remains constant on a mass basis. This varies from the previous Example II which assumed that the solids fraction remains constant on a volume basis.

A theoretical model is again developed, as in Example II, establishing the format of the equations as a function of component dielectric constants.

As stated in Example II, the mixture dielectric constant (S) for aerated primary froth is assumed to be the sum of its individual component contributions on a volume basis, expressing equation (12) again as:

$$S=\Sigma_i(\epsilon_i v_i) \quad (18)$$

where $\epsilon_i$ is the dielectric constant for component i, $v_i$ is the volume fraction of component i, and subscript i can be oil, water, solids or air.

Equation (18) was re-written in terms of mass using:

$$v_i=\frac{m_i\rho_t v_t}{\rho_i} \quad (19)$$

and rewriting the mass of oil ($m_o$) in terms of water and solids with the mass conservation equation as shown:

$$m_t=m_o+m_w+m_s+m_a \quad (20)$$

and assuming mass of air, $m_a$ to be negligible, the mass fraction of water, $m_w$ can then be shown to be a function of S, $\epsilon_i$, $\rho_t$, $\rho_i$ and $m_s$, $$m_w=\frac{(S-\epsilon_a)-\rho_t m_s\left[\frac{(\epsilon_s-\epsilon_a)}{\rho_s}-(\epsilon_o-\epsilon_a)\right]}{\rho_t(\epsilon_w-\epsilon_o)} \quad (21)$$

where $\rho_t$ is the density of aerated froth and $\rho_i$ is the density of component i. In deriving equation (21), it was assumed that $\rho_o=\rho_w=1$, for a system temperature of 75° C., $\epsilon_i$ are constant.

During normal plant operation, the average PSV froth solids assay typically ranges from 8–10 weight %. Therefore, for this example, the mass fraction of PSV froth solids is assumed to be constant at 9 weight %. Now, $m_w$ is the only unknown in equation (21) and can be rewritten in terms of microwave signal and froth density, with $k_i$ acting as calibration constants as shown in equation (22):

$$m_w = \frac{k_1 S}{\rho_t} + \frac{k_2}{\rho_t} + k_3 \tag{22}$$

Calibration was done to determine coefficients, $k_i$ in the theoretical model equation (22) based on a set of assays done on grab samples, matched with simultaneous recording of froth bulk density and microwave froth quality monitor signals. As a result, the component dielectric constants were redefined into constant $k_i$ and the individual component dielectric constants need not be specified.

The froth quality, in terms of the weight percent of oil can be obtained using the mass conservation equation:

$$m_o=100-m_w-m_s \tag{23}$$

with $m_s=9$ weight % and equation (22), equation (23) becomes:

$$m_o = 91 - k_3 - \frac{k_1 S}{\rho_t} - \frac{k_2}{\rho_t} \tag{24}$$

and equation (24) may be further rewritten as:

$$m_o = k_4 - \frac{k_3}{\rho_t} + \frac{k_6 S}{\rho_t} \tag{25}$$

To obtain the calibration constants $k_i$, the microwave and density sensors were tested under a variety of plant operating conditions including periods of steady and unsteady operation. No physical problems with the sensors were encountered. Plant data were divided into two groups, i.e. 1990 and 1991 data sets. Calibration and validation were done using the 1990 and 1991 data sets respectively. The derived model was then used to estimate the froth quality during a plant test and the results compared with the grab samples.

Figure 12:
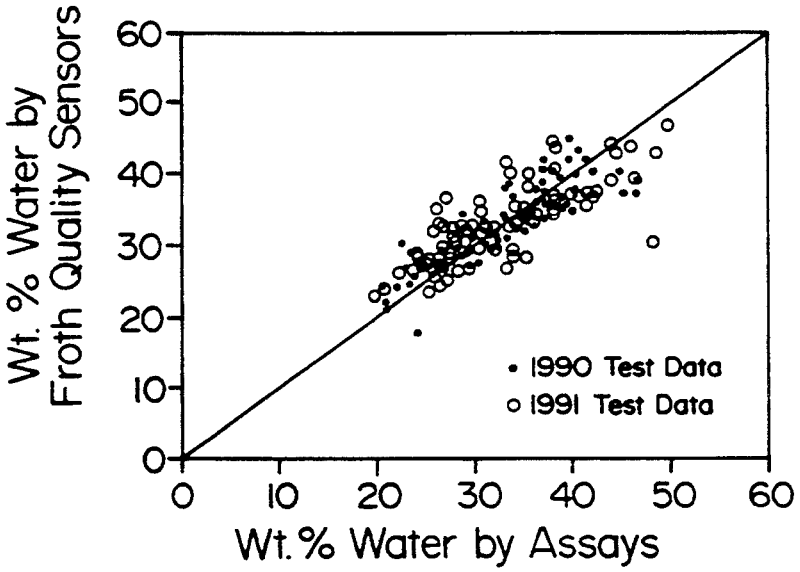
FIG. 12 is a plot of the predicted and measured or assayed froth water fractions from a test performed on a commercial plant PSV unit.

Multiple linear regression was used to determine model coefficients, $k_i$. Using 1990 data, the model equation (22) with parameter estimates became:

$$m_w = \frac{5.36\,S}{\rho_t} + \frac{8.37}{\rho_t} - 15.7 \tag{26}$$

with a correlation coefficient $r^2=0.76$, which indicates a good correlation. If re-written in terms of volume fraction, this equation would have a format similar to equation (17) of example II. Equation (26) was used to estimate PSV froth water content for the 1991 data set and results compared with grab assays results. The results are shown in FIG. 11 in terms of the predicted and measured froth water contents. If the values as measured by the sensors are the same as the assay values, data should fall on the 45° line. The variability observed in FIG. 12 is due to both error in model estimations and error in grab assays. The relative error associated with PSV froth water grab assay ranged from 4% to 18%.

Figure 13:
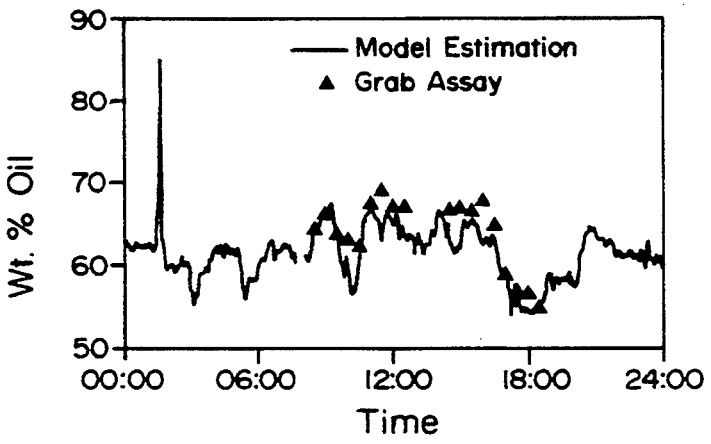
FIG. 13 is a plot of the predicted froth quality, as weight % oil, compared with actual grab sample assays from a test performed on the commercial plant PSV unit.

A time trend plot of the estimated froth quality using equation (26) for a plant test is shown in FIG. 13. The PSV froth grab assays are included for comparison. The sensor measurements closely follow the trend of grab samples. A change in froth quality by grab assay is also seen in the response of the sensors.

From the results presented in FIG. 13, it may be seen that the froth quality may be closely determined having obtained measures of the bulk density and the microwave froth quality monitor signal.

EXAMPLE IV

This example demonstrates that assumptions other than constant volume fraction of solids can be made to reach substantially the same final results for froth quality.

From a simple derivation, applying the mass conservation equation, converting mass fraction to volume fraction and finally assuming that the output from the microwave froth quality monitor is linearly related to the volume fraction of water in the froth, the following equation may be formed:

$$m_o = 1 + \frac{k_1}{\rho_t} + \frac{k_2 S}{\rho_t} + \frac{\rho_s v_s}{\rho_t} \tag{27}$$

where $k_i$ are calibration constants.

Assumptions with respect to the solids may be made. As in Example I and II, the volume fraction of solids $v_s$ may be assumed constant. In Example III, the mass fraction of solids ($\rho_s v_s/\rho_t$) was assumed constant. Other relationships of solids content may be made including: mass of solids is constant; mass of solids is small and may be neglected; and the volume of solids is proportional to the volume of water. All of these approaches allow the equation (27) to be rewritten as:

$$m_o = k_1 + \frac{k_2}{\rho_t} + \frac{k_3 S}{\rho_t} \tag{28}$$

Other model forms can also be used such as a result of applying multiple regression techniques to a group of assay data and the measured values of microwave froth quality monitor and bulk density. Considering that the above examples have established that solids content is essentially constant, one would expect that a regression analysis would have a good statistical match when solely the two values of froth quality monitor output (S) and bulk density ($\rho_t$) are used as variables. In fact, multiple regression analysis has resulted in equation 29 below $$m_o=k_1+k_2S+k_3\rho_t \tag{29}$$

which has also been found to predict the froth quality satisfactorily.

This example illustrates that once an assumption is made with respect the constant nature of the solids content, relationships may be derived which express the quality of aerated bitumen froth simply in terms of froth bulk density ($\rho_t$) and the output (S) of the microwave froth quality monitor.

The embodiments of the invention in which an exclusive property or privilege is claimed are defined as follows;

1. A method for establishing the quality of aerated bitumen froth produced in a hot water extraction process circuit, the solids content being substantially constant, said method comprising:

(a) repetitively establishing on-line measurements indicative of the bulk density of the froth, (b) repetitively establishing on-line measurements indicative of the mixture dielectric of the froth using microwave energy;

(c) repetitively using the respective measurements to compute measures indicative of the respective volume fractions or weight fractions of the bitumen and water in the froth, whereby the quality of the froth may be continuously determined.

2. The method as set forth in claim 1 wherein the mixture dielectric is established by:

flowing froth through a cell forming a tubular, open-ended resonant cavity, transmitting microwave energy through the froth between spaced antennae positioned in the cavity, and measuring the resonant frequency produced, to provide the measurements indicative of the mixture dielectric.

3. The method as set forth in claim 2, comprising:

as a preliminary calibration step, comparing a series of on-line measurements indicative of the bulk density and mixture dielectric of the froth with a series of laboratory assays of froth samples, periodically and simultaneously gathered with the series on-line measurements, to better align the determined quality of the froth with the actual quality of the froth.

4. The method as set forth in claim 1 comprising:

as a preliminary calibration step, comparing a series of on-line measurements indicative of the bulk density and mixture dielectric of the froth with a series of laboratory assays of froth samples, periodically and simultaneously gathered with the series of on-line measurements, to better align the determined quality of the froth with the actual quality of the froth.

5. A method for establishing an indication of the water content in aerated primary bitumen froth produced in a hot water extraction process circuit, comprising:

(a) suspending a microwave cell forming an open-ended resonant cavity in a submerged condition in the froth so that the froth flows through the cavity; and (b) applying microwave energy to the froth in the cavity and producing signals indicative of the resonant frequency produced in the cavity, establishing a measure of the water content in the froth.

6. A method for establishing the quality of aerated primary bitumen froth produced by a primary separation vessel in a hot water extraction process circuit, the solids content being small and constant, the method comprising:

(a) repetitively establishing on-line measurements indicative of the bulk density of the froth, (b) applying microwave energy in a cell forming a tubular, open-ended resonant cavity through which the froth flows, the resonant frequency produced being measured repetitively, establishing on-line measurements indicative of the mixture dielectric of the froth;

(c) repetitively using the respective measurements to compute measures indicative of the respective volume fractions or weight fractions of the bitumen and water in the froth, whereby the quality of the froth may be continuously determined.

7. The method as set forth in claim 6 comprising:

as a preliminary calibration step, comparing a series of on-line measurements indicative of the bulk density and mixture dielectric of the froth with a series of laboratory assays of froth samples, periodically and simultaneously gathered with the series of on-line measurements, to better align the determined quality of the froth with the actual quality of the froth.

* * * * *